US007354508B2

(12) United States Patent
Adams et al.

(10) Patent No.: US 7,354,508 B2
(45) Date of Patent: Apr. 8, 2008

(54) PROCESS TO PREPARE A HEAVY AND A LIGHT LUBRICATING BASE OIL

(75) Inventors: Nicholas James Adams, Petit Couronne (FR); Jan Lodewijk Maria Dierickx, Amsterdam (NL); Gilbert Robert Bernard Germaine, Petit Couronne (FR); Laurent Georges Huve, Amsterdam (NL); David John Wedlock, Chester (GB)

(73) Assignee: Shell Oil Company, Houston, TX (US)

( * ) Notice: Subject to any disclaimer, the term of this patent is extended or adjusted under 35 U.S.C. 154(b) by 25 days.

(21) Appl. No.: 10/520,802

(22) PCT Filed: Jun. 25, 2003

(86) PCT No.: PCT/EP03/06761

§ 371 (c)(1),
(2), (4) Date: Jun. 27, 2005

(87) PCT Pub. No.: WO2004/007647

PCT Pub. Date: Jan. 22, 2004

(65) Prior Publication Data

US 2005/0236301 A1 Oct. 27, 2005

(30) Foreign Application Priority Data

Jul. 12, 2002 (EP) ..... 02291772

(51) Int. Cl.
*C10G 75/38* (2006.01)
*C10G 7/00* (2006.01)

(52) U.S. Cl. ..... 208/92; 208/18; 208/27; 508/110

(58) Field of Classification Search ..... 208/18, 208/27, 92; 508/110
See application file for complete search history.

(56) References Cited

U.S. PATENT DOCUMENTS

| | | | | |
|---|---|---|---|---|
| 3,788,972 | A | 1/1974 | Henry et al. | 208/59 |
| 3,876,522 | A | 4/1975 | Campbell et al. | 208/58 |
| 4,343,692 | A | 8/1982 | Winquist | 208/111 |
| 4,574,043 | A | 3/1986 | Chester et al. | 208/59 |
| 4,859,311 | A | 8/1989 | Miller | 208/89 |

(Continued)

FOREIGN PATENT DOCUMENTS

| | | |
|---|---|---|
| AU | 698392 | 10/1998 |

(Continued)

OTHER PUBLICATIONS

International Search Report dated Oct. 20, 2003.

(Continued)

*Primary Examiner*—Glenn Caldarola
*Assistant Examiner*—Prem C. Singh

(57) ABSTRACT

The invention relates to a process to prepare a heavy and a light lubricating base oil from a partly isomerized Fischer-Tropsch derived feedstock, the feedstock having an initial boiling point of below 400° C. and a final boiling point of above 600° C. by (a) separating the fraction via distillation into a light base oil precursor fraction and a heavy base oil precursor fraction; (b) reducing the pour point of each separate base oil precursor fraction via dewaxing; and, (c) isolating the desired base oil products from the dewaxed oil fractions as obtained in step (b).

20 Claims, 1 Drawing Sheet

U.S. PATENT DOCUMENTS

| | | | | |
|---|---|---|---|---|
| 5,053,373 | A | 10/1991 | Zones | 502/64 |
| 5,157,191 | A | 10/1992 | Bowes et al. | 585/533 |
| 5,252,527 | A | 10/1993 | Zones | 502/64 |
| 5,580,442 | A | 12/1996 | Kwon et al. | 208/89 |
| 5,785,862 | A | 7/1998 | Graham et al. | |
| 6,080,301 | A * | 6/2000 | Berlowitz et al. | 208/18 |
| 6,090,989 | A | 7/2000 | Trewella et al. | 585/13 |
| 6,179,994 | B1 | 1/2001 | Clark et al. | 208/27 |
| 6,475,960 | B1 * | 11/2002 | Berlowitz et al. | 508/110 |

FOREIGN PATENT DOCUMENTS

| | | | |
|---|---|---|---|
| EP | 0161833 | | 11/1985 |
| EP | 0237655 | | 6/1992 |
| EP | 0668342 | | 8/1995 |
| EP | 0776959 | | 6/1997 |
| EP | 0776959 | A2 | 6/1997 |
| EP | 0832171 | | 1/2000 |
| EP | 1029029 | | 8/2000 |
| EP | 1144551 | | 10/2001 |
| EP | 1042067 | | 4/2004 |
| EP | 0876446 | | 7/2004 |
| EP | 1547684 | | 6/2005 |
| EP | 1548088 | | 6/2005 |
| EP | 1352040 | | 8/2005 |
| WO | 97/18278 | | 5/1997 |
| WO | WO9721788 | | 6/1997 |
| WO | 99/20720 | | 4/1999 |
| WO | WO9920720 | | 4/1999 |
| WO | WO9934917 | | 7/1999 |
| WO | 99 41334 | | 8/1999 |
| WO | 00/14187 | | 3/2000 |
| WO | 00 15736 | | 3/2000 |
| WO | 00/29511 | | 5/2000 |
| WO | WO0029511 | | 5/2000 |
| WO | 02 50213 | | 6/2002 |

OTHER PUBLICATIONS

"Lubricant Base Oil and Wax Processing", Avilino Sequeira, Jr., Marcel Dekker Inc., NY 1994, Chapter 7.

"Verified Synthesis of Zeolitic Materials", Micropoores and mesopores materials, vol. 22 1998, pp. 644-645.

Oil and Gas Journal, "First Lubricant-Oil Cracker Has Trouble Free Record," Jun. 1971, pp. 94-97.

Hydrocarbon Processing, Consider Hydrorefining For Lubes, by A. Billon, J. P. Franck, and J. P. Peries, Sep. 1975, pp. 139-144.

"IFP's New Flexible Hydrocracking Process Combines Maximum Conversion With Production of High Viscosity, High VI Lube Stocks," by A. Hennico, A. Billon, P. H. Bigeard, and J. P. Peries published 1992.

* cited by examiner

PROCESS TO PREPARE A HEAVY AND A LIGHT LUBRICATING BASE OIL

PRIORITY CLAIM

The present application claims priority on European Patent Application 02291772.8 filed 12 Jul. 2002.

FIELD OF THE INVENTION

The invention relates to a process to prepare a heavy and a light lubricating base oil.

BACKGROUND OF THE INVENTION

Solvent refining processes are used to prepare base oils having the properties of residual base oils to light base oils from a petroleum derived source. Light base oils are prepared by solvent refining a lower boiling vacuum distillate stream and the residual base oils are prepared by solvent refining a de-asphalted vacuum residue. Various intermediate grades can be prepared from the intermediate boiling feedstocks. The resulting base oils may have a kinematic viscosity at 100° C. from 2 cSt for the light base oils to above 30 cSt for the heaviest grades.

There is a tendency in the base oil field to prepare base oils which contain more saturated components and less sulfur and which have a higher viscosity index than the base oils which can be made by means of the above described solvent refining route. A suitable process is to catalytically dewax the residual fraction obtained in a fuels hydrocracker process. A fuels hydrocracker process is a process wherein a feedstock is hydroprocessed to mainly middle distillate fuels products. The higher boiling fraction is usually recycled to the hydrocracking step. This bottoms fraction, also referred to as hydrocracker bottoms, can also be used to prepare base oils. Such a process is for example described in WO-A-9718278 and in WO-A-0250213. A disadvantage of the process as described above is that it has been found difficult to prepare the high viscosity product at all or in a sufficient quantity.

Different publications disclose the preparation of Fischer-Tropsch derived base oils. However no publication has disclosed a process for the simultaneous preparation of both low and high viscosity base oils. For example EP-A-1029029, WO-A-0014187 and EP-A-776959 describe the preparation of low viscosity grade base oil from a Fischer-Tropsch derived feed. The kinematic viscosity at 100° C. of the disclosed base oils ranged from 5.1 to 7.9 cSt. WO-A-0015736 discloses a process in which base oil is obtained from a Fischer-Tropsch derived feed having a kinematic viscosity at 100° C. of 24.89 cSt.

It would be useful to provide a process which can prepare at least a light and a heavy base oil.

SUMMARY OF THE INVENTION

The invention is directed to a process to prepare a heavy base oil having a kinematic viscosity at 100° C. of above 15 cSt and a light lubricating base oil having a kinematic viscosity at 100° C. of between 3.8 and 6 cSt from a partly isomerized Fischer-Tropsch derived feedstock, said feedstock having an initial boiling point of below 400° C. and a final boiling point of above 600° C. and the fraction boiling above 540° C. is at least 20 wt % said process comprising:

(a) separating, via distillation, said fraction into a light base oil precursor fraction and a heavy base oil precursor fractions;

(b) reducing the pour point of each separate base oil precursor fraction by means of dewaxing; and, (c) isolating the desired base oil products from said dewaxed oil fractions as obtained in step (b).

BRIEF DESCRIPTION OF THE DRAWINGS

The invention shall be illustrated by making use of FIGS. 1 and 2.

DETAILED DESCRIPTION OF THE INVENTION

Figure 1:
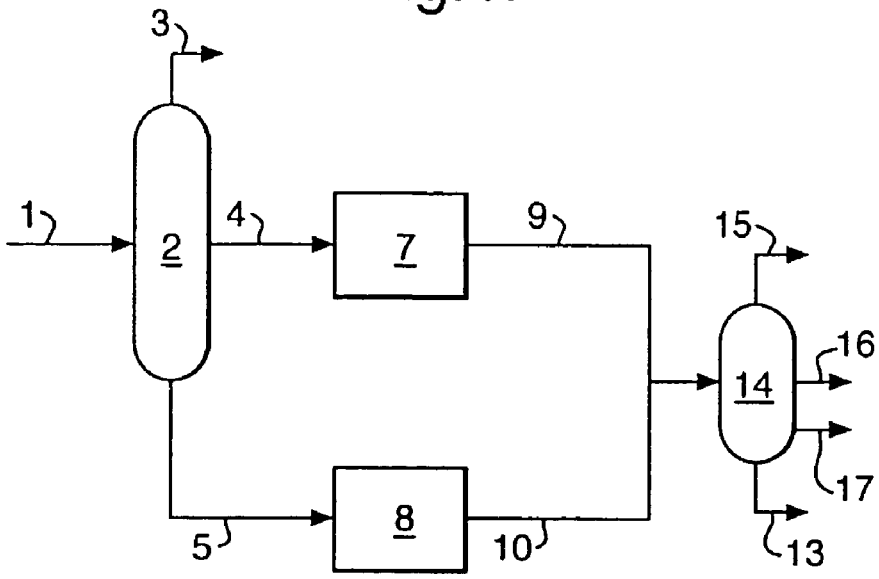
FIG. 1 shows an example of a preferred embodiment of the process according to the present invention.

Applicants have found that with the process according to the invention highly saturated base oils containing almost no sulfur and having a high viscosity index may be prepared. Furthermore, different base oil grades may be prepared using this process, ranging from the low viscosity grades to the high viscosity grades. For example, a base oil product slate, wherein the different products have kinematic viscosities at 100° C. of about 2, 5, 8.5 and 20 cSt respectively may be prepared with a high yield. By dewaxing the light and heavy base oil precursor fractions separately, the pour points of the resulting light and heavy base oils may be targeted to their most optimal value. If no separate dewaxing is performed the pour point of one grade will then be the resultant of the pour point of the other grade. This results in an undesirable reduction in quality and non-optimal yields per grade.

The preferred feed to step (a) may suitably be the heavy fraction as obtained when hydrocracking a Fischer-Tropsch synthesis product. Such a Fischer-Tropsch synthesis product will comprise mainly normal paraffins with up to and above 60 carbon atoms. This synthesis product is suitably hydroprocessed hydroisomerization/hydrocracking) into one or more middle distillate products and a heavy, atmospheric bottoms product fraction. This heavy bottoms product fraction having an initial boiling point of below 400° C. and preferably above 300° C. and more preferably above 340° C. may comprise mainly partly isomerized paraffins. An example of a suitable hydroprocessing process for a Fischer-Tropsch synthesis product is described in EP-A-668342.

The fraction boiling above 540° C. in the feed to step (a) is preferably at least 20 wt % and more preferably at least 30 wt % and most preferably at least 40 wt %. Typically, this fraction will be less than 80 wt %. Such heavy Fischer-Tropsch derived feeds may be preferably obtained when a relatively heavy Fischer-Tropsch synthesis product is hydrocracked. Not all Fischer-Tropsch synthesis processes yield such a heavy product. A preferred Fischer-Tropsch process from which product the feed for the present invention may be obtained is described in WO-A-9934917 and in AU-A-698392.

In step (a) the feed is separated by means of distillation into a light base oil precursor fraction and a heavy base oil precursor fraction. The distillation is suitably performed at vacuum pressures, more preferably the vacuum distillation is performed at a pressure of between 0.01 and 0.1 bara. Preferably, the effective cut temperature in step (a) at which the light and heavy base oil precursor fractions are separated is between 470° C. and 600° C. and more preferably between 480° C. and 580° C. The effective cut temperature is the temperature above which 90 wt % of the hydrocarbons recovered boil. Suitably the feed is separated into two base oil precursor fractions. Separation into additional base oil precursor fractions is also possible. A lower boiling fraction, boiling in the vacuum gas oil range, may also be obtained in the distillation of step (a) and may be used as a gas oil (blending) component or a technical white oil.

Step (b) may be performed by means of solvent dewaxing or catalytic dewaxing. Solvent dewaxing is well known to those skilled in the art and involves admixture of one or more solvents and/or wax precipitating agents with the base oil precursor fraction and cooling the mixture to a temperature in the range of from -10° C. to -40° C. , preferably in the range of from -20° C. to -35° C. , to separate the wax from the oil. The oil containing the wax is usually filtered through a filter cloth may be made of textile fibers, such as cotton; porous metal cloth; or cloth made of synthetic materials. Examples of solvents which may be employed in the solvent dewaxing process are $C_3$-$C_6$ ketones (e.g. methyl ethyl ketone, methyl isobutyl ketone and mixtures thereof), $C_6$-$C_{10}$ aromatic hydrocarbons (e.g. toluene), mixtures of ketones and aromatics (e.g. methyl ethyl ketone and toluene), and autorefrigerative solvents such as liquefied, normally gaseous $C_2$-$C_4$ hydrocarbons such as propane, propylene, butane, butylene and mixtures thereof. Mixtures of methyl ethyl ketone and toluene or methyl ethyl ketone and methyl isobutyl ketone are generally preferred. Examples of these and other suitable solvent dewaxing processes are described in Lubricant Base Oil and Wax Processing, Avilino Sequeira, Jr, Marcel Dekker Inc., New York, 1994, Chapter 7.

Preferably, step (b) is performed via a catalytic dewaxing process. The catalytic dewaxing process may be any process wherein, in the presence of a catalyst and hydrogen, the pour point of the base oil precursor fraction is reduced. Suitable dewaxing catalysts may be heterogeneous catalysts comprising a molecular sieve optionally in combination with a metal having a hydrogenation function, such as the Group VIII metals. Molecular sieves, and more suitably intermediate pore size zeolites, have shown a good catalytic ability to reduce the pour point of the base oil precursor fraction under catalytic dewaxing conditions. Preferably, the intermediate pore size zeolites have a pore diameter of between 0.35 nm and 0.8 nm. Suitable intermediate pore size zeolites are mordenite, ZSM-5, ZSM-12, ZSM-22, ZSM-23, SSZ-32, ZSM-35 and ZSM-48. Another preferred group of molecular sieves are the siica-aluminaphosphate (SAPO) materials of which SAPO-11 is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Pt/ZSM-35, Ni/ZSM-5, Pt/ZSM-23, Pd/ZSM-23, Pt/ZSM-48 and Pt/SAPO-11. Further details and examples of suitable molecular sieves and dewaxing conditions are for example described in WO-A-9718278, U.S. Pat. No. 4,343,692, U.S. Pat. No. 5,053,373, U.S. Pat. No. 5,252,527 and U.S. Pat. No. 4,574,043.

The dewaxing catalyst suitably also comprises a binder. The binder may be a synthetic or naturally occurring (inorganic) substance, for example clay, silica and/or metal oxides. Natural occurring clays are, for example, of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thona, silica-alumina-zircoma, silica-alumina-magnesia and silica-magnesia-zirconia. More preferably, a low acidity refractory oxide binder material, which is essentially free of alumina, is used. Examples of these binder materials are silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment comprises contacting an extrudate of the binder and the zeolite with an aqueous solution of a fluorosilicate salt as described in, for example, U.S. Pat. No. 5,157,191 or WO-A-0029511. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22, as for example described in WO-A-0029511 and EP-B-832171.

More preferably, the molecular sieve is a MTW, MTT or TON type molecular sieve, of which examples are described above, the Group VIII metal is platinum or palladium and the binder is silica.

Preferably, the catalytic dewaxing of the heavy base oil precursor fraction is performed in the presence of a catalyst as described above wherein the zeolite has at least one channel with pores formed by 12-member rings containing 12 oxygen atoms. Preferred zeolites having 12-member rings are of the MOR type, MTW type, FAU type, or of the BEA type (according to the framework type code). Preferably, an MTW type, for example ZSM-12, zeolite is used. A preferred MTW type zeolite containing catalyst also comprises a platinum or palladium metal as Group VIII metal and a silica binder. More preferably, the catalyst is a silica bound AHS treated Pt/ZSM-12 containing catalyst as described above. These 12-member ring type zeolite based catalysts are preferred because they may be used to convert waxy paraffinic compounds to less waxy iso-paraffinic compounds.

More preferably, the above described catalyst comprising the 12-member ring zeolite is used in a first hydroconversion step to lower the pour point of the base oil precursor to an intermediate value between the pour point of the feed and the pour point of the final base oil. More preferably, the pour point of the intermediate product is between −10 to +10° C. The process conditions of such a first step may suitably be the catalytic dewaxing conditions as described below. This first hydroconversion step is followed by a final dewaxing step wherein a catalyst is used which, preferably, comprises a zeolite having at least one channel with pores formed by 10-member rings containing 10 oxygen atoms. Suitably, as 10-member ring zeolites, one of the following list comprising a TON type, MFI type, MTT type or FER type is used. The specific catalyst may be one as disclosed above which are according to these zeolite types. A preferred 10-member ring zeolite containing catalyst will also comprise a platinum or palladium metal as Group VIII metal and a silica binder. More preferably, the catalyst is a silica bound AHS treated Pt/ZSM-5 or a silica bound AHS treated Pt/ZSM-23 containing catalyst as described above.

In an even more preferred embodiments, the light base oil precursor fraction is also catalytic dewaxed as described above for the heavy base oil precursor fraction.

Applicants have found that the two-step process as described above for reducing the pour point may also be used in processes to prepare base oils having a pour point of suitably below −15° C., more preferably below −20° C., from a feedstock comprising between 30 and 100 wt % wax, preferably between 50 and 100 wt % wax. The wax content is defined as the wax content which is recovered by solvent dewaxing at −27° C. in a standard methyl-ethylketone toluene mixture. Such a feedstock may be obtained in a Fischer-Tropsch process such as for example described above. Other suitable feedstocks are the residual fraction obtained in a fuels hydrocracker process or a (hydrotreated) slack wax.

Catalytic dewaxing conditions are known in the art and typically involve operating temperatures in the range of from 200° C. to 500° C., suitably from 250° C. to 400° C., hydrogen pressures in the range of from 10 bar to 200 bar, preferably from 40 bar to 70 bar, weight hourly space velocities (WHSV) in the range of from 0.1 to 10 kg of oil per liter of catalyst per hour (kg/l/hr), suitably from 0.2 to 5 kg/l/hr, more suitably from 0.5 to 3 kg/l/hr and hydrogen to oil ratios in the range of from 100 to 2,000 liters of hydrogen per litre of oil.

By varying the temperature between 275° C. and 375° C., suitably between 315° C. and 375° C. at between 40-70 bars, in the catalytic dewaxing step it is possible to prepare base oils having different pour point specifications varying from suitably +10° C. for the heavier grades to as low as -60° C. for the lighter grades.

In step (c) the effluents of the separate dewaxing steps may be separated by means of distillation into at least a light and heavy base oil grade. The distillation is suitably performed at low (vacuum) pressures, more preferably the vacuum distillation is performed at a pressure of between 0.01 and 0.1 bara. Preferably, the effective cut temperature in step (c) at which the light and heavy base oil fractions may be separated is between 470° C. and 600° C. and more preferably between 480° C. and 540° C. Step (c) is preferably performed in one distillation column. Line-ups wherein two or more vacuum distillations columns may be used could also be envisaged.

With the process of the present invention, base oil products may be obtained having a kinematic viscosity at 100° C. of above 15 cSt and more preferably above 17 cSt and most preferably above 20 cSt. Preferably, the kinematic viscosity of said products is less than 40 cSt. The pour point of these base oil grades may be below +10° C., preferably below −10° C. and even more preferably below −20 C. The viscosity index of these grades are preferably between 140 and 200.

Applicants have found that when these heavy base oil products are used in lubricant formulations less or even no viscosity modifier additive may be required. It has been found that especially SAE "xW-y" viscosity lubricant formulations, wherein y-x is greater or equal than 25 may be obtained without having to use a Viscosity Modifier. The SAE J300 classification is meant here the standard as in force at the time of filing of this application. SAE stands for Society of Automotive Engineers in the USA. The "x" number in such a designation is associated with a maximum viscosity requirement at low temperature for that composition as measured typically by a cold cranking simulator (VdCCS) under high shear. The second number "y" is associated with a kinematic viscosity requirement at 100° C. The heavy base oil may be combined with another Fischer-Tropsch derived base oil to formulate the above lubricant formulations or in combination with other base oils. Other base oils are for example mineral oils, polyalphaolefins, esters, polyalkylenes, alkylated aromatics, hydrocrackates and solvent-refined basestocks. The invention is also directed to the use of the heavy grade base oil in motor oil formulations which do not require a viscosity modifier.

Applicants further found that when a viscosity modifier-free lubricant is used as motor engine lubricant in gasoline direct injection (GDI) engines no build up of residue on the back of the inlet valve tulip occurs.

In FIG. 1 a Fischer-Tropsch derived feedstock 1 is fed to a vacuum distillation column 2. In this column the feed 1 is separated into a vacuum gas oil fraction 3, a light base oil precursor fraction 4 and a heavy base oil precursor fraction 5. The viscosity of the targeted base oils will depend on the viscosity of the base oil precursor fractions 4,5. The desired viscosity of these precursor fractions may be obtained by manipulating the distillate cut point in step (a).

In FIG. 1 the catalytic dewaxing step (b) is performed in two parallel operating catalytic dewaxing reactors 7,8. Alternatively, one solvent or catalytic dewaxing reactor may also be used, wherein base oil precursor fractions 4,5 are processed alternatively (in a so-called blocked out mode). The latter operation requires less reactors but on the other hand requires more intermediate storage and operational changes. Thus, preferably, two parallel-operated dewaxing reactors are used. In this manner dedicated dewaxing catalysts may be advantageously used, in case catalytic dewaxing is used.

The effluents 9,10 of the dewaxing step (b) as performed on fractions 4,5 are separated in one distillation column 14. In column 14 various base oil grades 16, 17, 13 may obtained after topping off the lower boiling fraction 15. Applicants have found that it is now possible to simultaneously obtain at least a light base oil grade 16 having a kinematic viscosity at 100° C. of about 3.8 cSt to 6 cSt which can be used in motor lubricant formulations, and a heavy base oil grade. In FIG. 1 two heavy base oil grades are illustrated. Line-ups wherein only one heavy base oil grade is prepared are also possible. The heavy base oil grade 17 preferably has a kinematic viscosity at 100° C. of between 7 cSt to 15 cSt. This base oil grade may be used as technical or medicinal white oil. A second heavy base oil grade 13 is also separated in column 14 having preferably a kinematic viscosity at 100° C. of above 15 cSt, more preferably above 17 cSt and even more preferably above 20 cSt. It may be advantageous to recycle part of the heavy grade 13 to the catalytic dewaxing reactor 8 in order to control the quality of said heavy base oil grade 13. In column 14 more grades (not shown) may be obtained having a kinematic viscosity at 100° C. of between 2 cSt and 4 cSt. The top fraction 15 boiling below the base oil grades can be used as fuel (gas oil, kerosene, naphtha, LPG) blending component.

Figure 2:
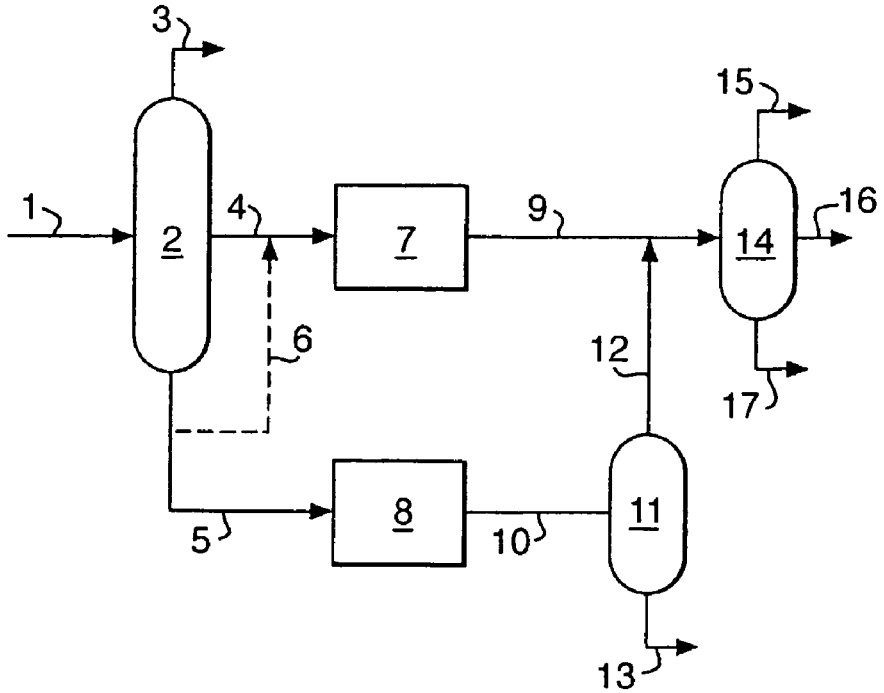
FIG. 2 shows the process of FIG. 1 except that two product vacuum distillation columns are used.

In FIG. 2 the effluent 10 is first separated in a heavy base oil column 11 into the heavy base oil 13 as described above and a lower boiling fraction 12. This lower boiling fraction 12 is preferably supplied to the base oil distillation column 14 as shown, fed to reactor 7 or to vacuum distillation column 2. The viscosity of the heavy base oil grade 17 may be controlled by adjusting the cut point in distillation column 2. Alternatively the viscosity of base oil grade 17 may be adjusted by adding some of the heavy base oil fraction 6 to the light base oil precursor fraction 4 before performing step (b).

In this application reference is made to kinematic viscosity as measured by ASTM D 445 and to pour point as measured by ASTM D 97-93.

The invention will be illustrated with the below non-limiting examples.

Preparation of the Dewaxing Catalyst

MTW Type zeolite crystallites were prepared as described in "Verified synthesis of zeolitic materials" as published in Micropores and mesopores materials, volume 22 (1998), pages 644-645 using tetra ethyl ammonium bromide as the template. The Scanning Electron Microscope (SEM) visually observed particle size showed ZSM-12 particles of between 1 and 10 μm. The average crystallite size as determined by XRD line broadening technique was 0.05 μm. The crystallites thus obtained were extruded with a silica binder (10% by weight of zeolite, 90% by weight of silica binder). The extrudates were dried at 120° C. A solution of $(NH_4)_2SiF_6$ (45 ml of 0.019 N solution per gram of zeolite crystallites) was poured onto the extrudates. The mixture was then heated at 100° C. under reflux for 17 h with gentle stirring above the extrudates. After filtration, the extrudates were washed twice with deionized water, dried for 2 hours at 120° C. and then calcined for 2 hours at 480° C.

The thus obtained extrudates were impregnated with an aqueous solution of platinum tetramine hydroxide followed by drying (2 hours at 120° C.) and calcining (2 hours at 300° C.). The catalyst was activated by reduction of the platinum under a hydrogen rate of 100 l/hr at a temperature of 350° C. for 2 hours. The resulting catalyst comprised 0.35% by weight Pt supported on the dealuminated, silica-bound MTW zeolite.

EXAMPLE 1

A partly isomerized Fischer-Tropsch derived wax having the properties as in Table 1 was distilled into a light base oil precursor fraction boiling substantially between 390° C. and 520° C. and a heavy base oil precursor fraction boiling above 520° C.

TABLE 1

| | |
|---|---|
| Density at 70° C. (kg/1) | 0.7874 |
| T10 wt % (° C.) | 346 |
| T50 wt % (° C.) | 482 |
| T90 wt % (° C.) | 665 |
| Wax congealing point (° C.) | 48 |

The heavy base oil precursor fraction was contacted with the above-described dewaxing catalyst. The dewaxing conditions were 40 bar hydrogen, WHSV=1 kg/l.h, a temperature of 340° C. and a hydrogen gas rate of 700 Nl/kg feed.

The dewaxed oil was distilled into two base oil fractions having the properties listed in Table 2.

TABLE 2

| | Light base oil | Heavy base oil |
|---|---|---|
| Boiling range of base oil product (° C.) | 390-520 | >520 |
| Yield on feed to dewaxer | 6.2 | 54.3 |
| Density at 20° C. (kg/l) | 0.8144 | 0.8336 |
| Pour point (° C.) | Not measured | −42 |

TABLE 2-continued

| | Light base oil | Heavy base oil |
|---|---|---|
| Kinematic viscosity at 100 ° C. (cSt) | 4.339 | 15.95 |
| Viscosity Index | 136 | 168 |
| Average molecular weight | 403 | 692 |

The light base oil precursor fraction was also catalytically dewaxed by contacting with the above described dewaxing catalyst. The dewaxing conditions were 40 bar hydrogen, WHSV=1 kg/l.h, a temperature of 310° C. and a hydrogen gas rate of 700 Nl/kg feed.

The dewaxed oil was distilled into two base oil fractions having the properties listed in Table 3.

TABLE 3

| Targeted oil grade | Base oil grade-4 | Base oil grade-5.5 |
|---|---|---|
| Targeted Boiling range of base oil product (° C.) | 400-455 | 420-520 |
| Yield on feed to dewaxer | 33.7% | 63.3% |
| Density at 20° C. (kg/l) | 0.8124 | 0.8183 |
| Pour point (° C.) | −32 | −22 |
| Kinematic viscosity at 100° C. (cSt) | 4.00 | 5.537 |
| Viscosity Index | 132 | 144 |
| Average molecular weight | 385 | 451 |
| T(10%), (50%), (90%) from TBP-GLC | 397/430/456 | 417/462/522 |

Above, the distillation of the effluents of the dewaxing of the heavy and light base oil precursor fractions was done separately. It will be clear to the skilled person that the said effluents can also be combined before distillation into the various base oil products.

EXAMPLE 2

Example 1 was repeated starting with a partly isomerized Fischer-Tropsch derived wax having the properties as listed in Table 4. This feed was distilled into a light base oil precursor fraction boiling substantially between 390° C. and 520° C. and a heavy base oil precursor fraction boiling above 520° C.

TABLE 4

| | |
|---|---|
| T10 wt % (° C.) | 549 |
| T50 wt % (° C.) | 656 |
| T90 wt % (° C.) | >750 |
| Congealing Point (° C.) | +106 |
| Viscosity Vk at 150° C. | 15.07 cSt |

The heavy base oil precursor fraction was contacted with the above-described dewaxing catalyst. The dewaxing conditions were 40 bar hydrogen, WHSV=1 kg/l.h, a temperature of 355° C. and a hydrogen gas rate of 700 Nl/kg feed.

The dewaxed oil was distilled into two base oil fractions having the properties listed in Table 5.

TABLE 5

| | Light base oil | Heavy base oil |
|---|---|---|
| Boiling range of base oil product (° C.) | 390-520 | >520 |
| Yield on heavy feed to dewaxer | 7.7 | 47 |
| Density at 20° C. (kg/l) | 0.8191 | 0.829 |
| Pour point (° C.) | Not measured | −15 |
| Kinematic viscosity at 100 ° C. (cSt) | 5.315 | 26.65 |
| Viscosity Index | 132 | 157 |
| Average molecular weight | 435 | 788 |

EXAMPLE 3

This example illustrates the use of a heavy Fischer-Tropsch derived base oil grade as part of a 5W-30 lubricant composition according to the so-called SAE J300 classification without having to use a viscosity modifier. The properties of the Fischer-Tropsch derived base oils and the resulting lubricant are presented in Table 6.

TABLE 6

| | Light base oil | Heavy base oil | 5W-30 lubricant formulation | Specification for a 5W-30 lubricant according to SAE J-300 |
|---|---|---|---|---|
| Light base oil | 100% | | 68.8 | |
| Additive Package (*) | | | 10 | |
| Pour point depressant | | | 0.2 | |
| Heavy base oil | | 100% | 21 | |
| Analysis | | | | |
| MRV @ −35 ° C., centi Poise | | | 13,415 and 13,475 | <60,000 |
| Yield stress @ −35 ° C. | | | no yield stress | no yield stress |
| Vdccs @ −30 C., Poise | 18.74 | | 64.11 | 66.00 max. |
| Kinematic viscosity at 100 ° C. (cSt) | 4.979 | 24.53 | 9.517 | 9.3 to 12.5 |
| Kinematic viscosity at 40 ° C. (cSt) | 25.22 | | | — |
| PourPoint (° C.) | −54 | +12 | −51 | — |

(*) the additive package was a standard package not containing a viscosity modifier additive.

We claim:

1. A process to prepare a heavy base oil having a kinematic viscosity at 100° C. of above 15 cSt and a light lubricating base oil having a kinematic viscosity at 100° C. of between 3.8 and 6 cSt from a partly isomerized Fischer-Tropsch derived feedstock, said feedstock having an initial boiling point of below 400° C. and a final boiling point of above 600° C. and the fraction boiling above 540° C. is at least 20 wt %, said process comprising:

(a) separating, via distillation, said feedstock into a light base oil precursor fraction and a heavy base oil precursor fraction;

(b) reducing the pour point of each separate base oil precursor fraction by means of dewaxing; and, (c) and isolating the desired base oil products from said dewaxed oil fractions as obtained in step (b).

2. The process of claim 1, wherein the effective cut temperature in step (a) at which the light and heavy base oil precursor fractions are separated is between 470° C. and 600° C.

3. The process of claim 1, wherein the fraction boiling above 540° C. in the feed to step (a) is at least 30 wt %.

4. The process of claim 1, wherein the heavy base oil as obtained in step (c) has a kinematic viscosity at 100° C. of above 17 cSt.

5. The process of claim 4, wherein a base oil having a kinematic viscosity at 100° C. of between 7 cSt and 15 cSt is isolated from the dewaxed light base oil precursor fraction.

6. The process of claim 1, wherein the dewaxing of the heavy and light base oil precursor fraction is performed simultaneously in two different reactors.

7. The process of claim 1, wherein the dewaxing step is performed by means of a catalytic dewaxing process in the presence of a catalyst comprising a medium pore size molecular sieve and a Group VIII metal.

8. The process of claim 7, wherein the molecular sieve is selected from the group consisting of a MTW, MTT and TON type molecular sieve.

9. The process of claim 7, wherein the Group VIII metal is platinum or palladium.

10. The process of claim 7, wherein the catalyst used in the catalytic dewaxing of the heavy base oil precursor fraction comprises a MTW molecular sieve, platinum or palladium as Group VIII metal and a silica binder.

11. The process of claim 10, wherein the catalytic dewaxing of both light and heavy base oil precursor fractions is performed in the presence of a catalyst comprising a MTW molecular sieve, platinum or palladium as Group VIII metal and a silica binder.

12. The process of claim 1, wherein the heavy base oil precursor fraction is reduced in pour point by first performing a pour point reducing step in the presence of a catalyst comprising a 12-member ring zeolite and secondly performing a catalytic dewaxing on the effluent of the first step in the presence of a 10-member ring zeolite.

13. The process of claim 12, wherein the pour point after the first dewaxing step is between −10° C. and +10° C.

14. The process of claim 2, wherein the fraction boiling above 540° C. in the feed to step (a) is at least 30 wt %.

15. The process of claim 1, wherein the heavy base oil as obtained in step (c) has a kinematic viscosity at 100° C. of above 20 cSt.

16. The process of claim 15, wherein a base oil having a kinematic viscosity at 100° C. of between 7 cSt and 15 cSt is isolated from the dewaxed light base oil precursor fraction.

17. The process of claim 8, wherein the Group VIII metal is platinum or palladium.

18. The process of claim 2, wherein the heavy base oil precursor fraction is reduced in pour point by first performing a pour point reducing step in the presence of a catalyst comprising a 12-member ring zeolite and secondly performing a catalytic dewaxing on the effluent of the first step in the presence of a 10-member ring zeolite.

19. The process of claim 18, wherein the pour point after the first dewaxing step is between −10° C. and +10° C.

20. The process of claim 3, wherein the heavy base oil as obtained in step (c) has a kinematic viscosity at 100° C. of above 20 cSt.

* * * * *